United States Patent [19]

Leupold

[11] Patent Number: 4,835,137

[45] Date of Patent: May 30, 1989

[54] PERIODIC PERMANENT MAGNET STRUCTURES

[75] Inventor: Herbert A. Leupold, Eatontown, N.J.

[73] Assignee: The United States of America as represented by the Secretary of the Army, Washington, D.C.

[21] Appl. No.: 268,826

[22] Filed: Nov. 7, 1988

[51] Int. Cl.[4] ..... H01F 7/22

[52] U.S. Cl. ..... 505/1; 335/216; 335/306; 315/535

[58] Field of Search ..... 335/212, 302, 304, 306; 315/5.24, 5.34, 5.35; 505/1

[56] References Cited

U.S. PATENT DOCUMENTS

| | | | |
|---|---|---|---|
| 2,952,803 | 9/1960 | Charles et al. | 335/302 |
| 3,768,054 | 10/1973 | Neugebauer | 335/306 X |
| 4,392,078 | 7/1983 | Noble et al. | 315/5.35 |
| 4,429,229 | 1/1984 | Gluckstern | 335/212 X |
| 4,614,930 | 9/1986 | Hickey et al. | 335/306 X |

*Primary Examiner*—George Harris

*Attorney, Agent, or Firm*—Sheldon Kanars; John K. Mullarney

[57] ABSTRACT

Periodic permanent magnet structures comprise a plurality of azimuthally circumscribed sections of hollow spherical flux sources such that each flat face of said sections abuts one or more superconducting planar sheets. The superconducting sheets act as magnetic mirrors to complete the magnetic image of the sections. This produces a uniform high field in the central cavity(s). Each spherical section has an axial bore hole through its magnetic poles. The flux sources are arranged tangent to each other with the bore holes coaxially aligned to form a continuous channel through which charges particles may travel.

11 Claims, 3 Drawing Sheets

PERIODIC PERMANENT MAGNET STRUCTURES

The invention described herein may be manufactured, used, and licensed by or for the Government for governmental purposes without the payment to me of any royalties thereon.

TECHNICAL FIELD

The present invention relates in general to high-field periodic permanent magnet (PPM) structures for use in microwave/millimeter devices such as traveling wave tubes (TWTs). Specifically, it relates to PPM structures comprised of hollow hemisphere or quarter sphere magnetic sections arranged in pearl string fashion on one or more superconducting plates.

BACKGROUND OF THE INVENTION

Both electromagnets and permanent magnets have been used to manipulate beams of charged particles. In traveling wave tubes, for example, magnets have been arranged around the channel through which the beam travels to focus the stream of electrons; that is, to reduce the tendency of the electrons to repel each other and spread out. Various configurations of permanent magnets (and pole pieces) have been tried in an attempt to increase the focusing effect while minimizing the weight and volume of the resulting device. In conventional traveling wave tubes, permanent magnets are typically arranged in a sequence of alternating magnetization, either parallel to, or anti-parallel to, the direction of the electron flow. The magnets (and pole pieces) are usually annular in shape and their axes are aligned with the path of the electron beam. Pole pieces, constructed of ferromagnetic material such as electrolytic iron, are often placed between the magnets and provide a path through which magnetic flux from the magnets may be directed into the working space along the axis of the traveling wave tube in order to influence the beam in the desired manner. The patent to Clarke, U.S. Pat. No. 4,731,598, issued Mar. 15, 1988, illustrates typical prior art, periodic permanent magnetic (PPM) structures.

One of the critical problems confronting those who develop magnetic structures used to contain or manipulate beams of charged particles has been how to more efficiently utilize the permanent magnet materials which make up the structure(s). Some specific problems: How to maximize the strength of the magnetic field along the path of the charged particle beam without increasing the mass of the magnetic structure; how to increase heat dissipation from the central cavity to the outside atmosphere; and how to gain access to the interior of the structure in a simple and efficient manner.

SUMMARY OF THE INVENTION

A primary object of the present invention is to increase heat dissipation from the beam cavity through which the charged particles travel so as to increase the efficiency of operation of the traveling wave tube(s).

Another object is to provide access to the TWTs beam or central cavity in a simple manner.

Related objects of the invention are to maintain the level of field strength of the "magic sphere" pearl string PPM configuration while decreasing the mass of the structure and the complexity of construction of the same.

The present invention makes advantageous use of hollow hemispherical flux sources or "magic igloos" and hollow quarter spherical flux sources previously disclosed in the co-pending applications of H. Leupole, Ser. No. 199,504, filed May 27, 1988 and Ser. No. 199,501, filed May 27, 1988.

In accordance with the present invention, azimuthally circumscribed sections of hollow spherical flux sources (i.e., one-half or one-quarter spherical structures) are placed in a series (10 or more) tangent to each other in pearl string fashion. One or more superconducting planar sheets abut the flat faces of the sections. the axial bore holes of the sections are coaxially aligned with each other to form a continuous channel or path through which a beam of charged particles will travel. The sections of flux sources are closely alike; and, in the preferred embodiments of the invention the magnetic field orientations in the central cavities of the sections are the same. this results in PPM structures of reduced mass.

In an embodiment of the invention, hollow hemispherical magnetic flux sources are placed such that a single superconducting planar sheet closes the "open" end of each hemisphere. The superconducting (diamagnetic) sheet reflects the magnetic structure of each hemisphere such that each appears magnetically as if a complete magnetic sphere were its source.

In another embodiment of the invention, a series of quarter spherical magnetic flux sources abut a superconducting planar sheet along one longitudinal meridian and a second superconducting planar sheet abuts the flux sources along a second longitudinal meridian ninety degrees removed from the first meridian. The magnetic "mirror" images of the quarter spherical structures or flux sources in the diamagnetic (superconducting) planes make the quarter spherical structures appear (magnetically) similar to a series of magnetic spheres.

BRIEF DESCRIPTION OF THE DRAWINGS

The invention will be more fully appreciated from the following detailed description when the same is considered in connection with the accompanying drawings in which.

DETAILED DESCRIPTION

Figure 1:
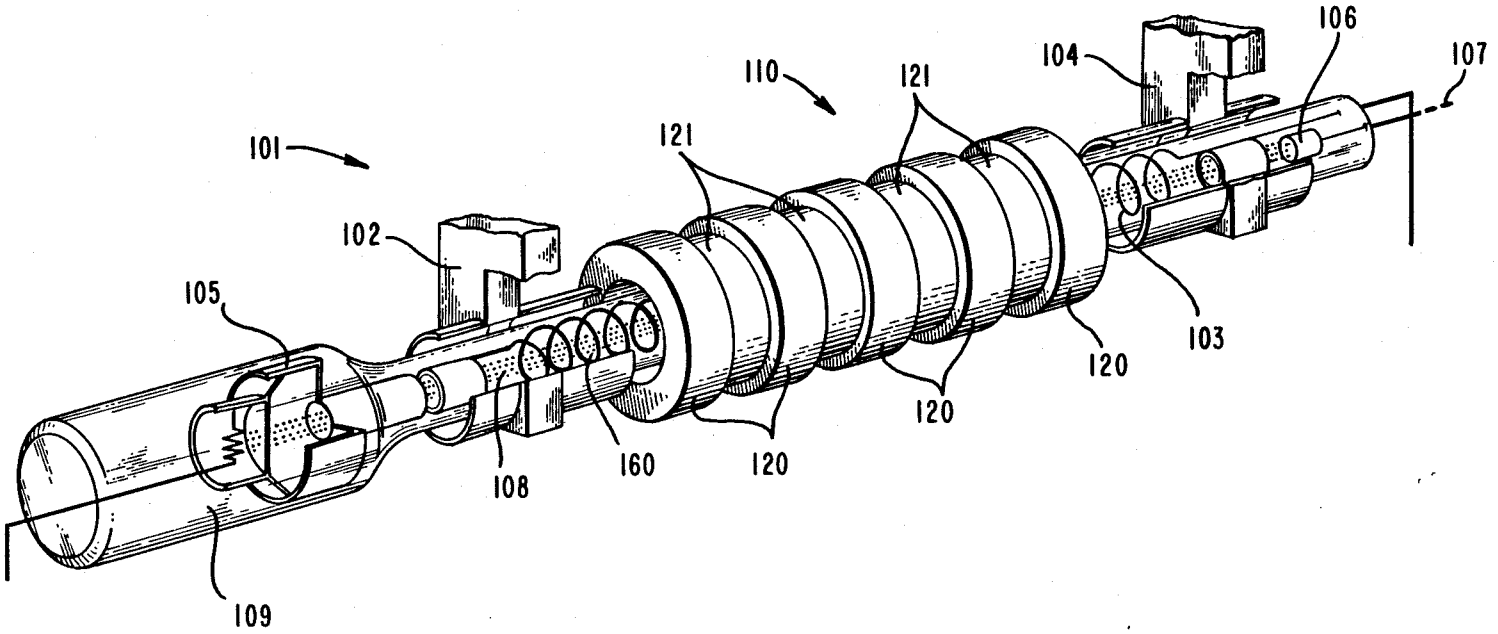
FIG. 1 (PRIOR ART)
FIG. 1 is a perspective view of a typical prior art traveling wave tube.

FIG. 1 shows a conventional traveling wave tube (TWT) 101. The major components of the TWT 101 are contained within the tube body 109. An evacuated working space 160 is established within the beam focusing structure 110 along the axis 107 of the tube 101. A microwave signal is applied at the input 102 and extracted at the output 104. this signal travels through the helical structure 103, which is wrapped around the longitudinal axis 107 of the tube 101. An electron beam 108 is produced by the electron gun 105, projected down the axis 107 of the tube 101, and absorbed at the collector 106. To focus the beam 108, a beam focusing system 110 surrounds the beam 108 and the helical structure 103. The interaction between the electron beam 108 and the microwave signal produces an amplification of the microwave signal.

The beam focusing structure 110 is designed to tightly focus the charged particle beam 108. The annular permanent magnets 120 are disposed in a coaxial manner with respect to the particle beam. The permanent magnets are typically arranged in a sequence of alternating magnetization, that is, the magnetic orientation alternates from magnet to magnet in the sequence. Magnets arranged in this alternating pattern are called "periodic permanent magnets." In between each of the successive magnets is an annular pole piece 121 which acts to draw magnetic flux from the magnets into the working space surrounding the beam path. Since TWTs and PPMs are so well known and so extensively described in the literature, the foregoing brief description should suffice for present purposes.

An improved PPM arrangement was disclosed in the co-pending application Ser. No. 213,970, filed July 1, 1988. In accordance with the invention of this co-pending application, a plurality of hollow spherical magnetic flux sources are placed tangent to each other in pearl string fashion. the axial bore holes of the spheres are coaxially aligned to form a continuous channel or path through which a beam of charged particles can travel. This PPM arrangement provides an increased magnetic field along the path of the charged particle beam, it presents higher maximum peak fields, a greater average field along the path, and so on. However, heat dissipation and accessibility problems presented by the prior art arrangements (e.g., FIG. 1) were not overcome in this "magic sphere" PPM arrangement. The present invention retains the advantages of the magic sphere PPM structure, while overcoming the above-noted problems.

Figure 2:
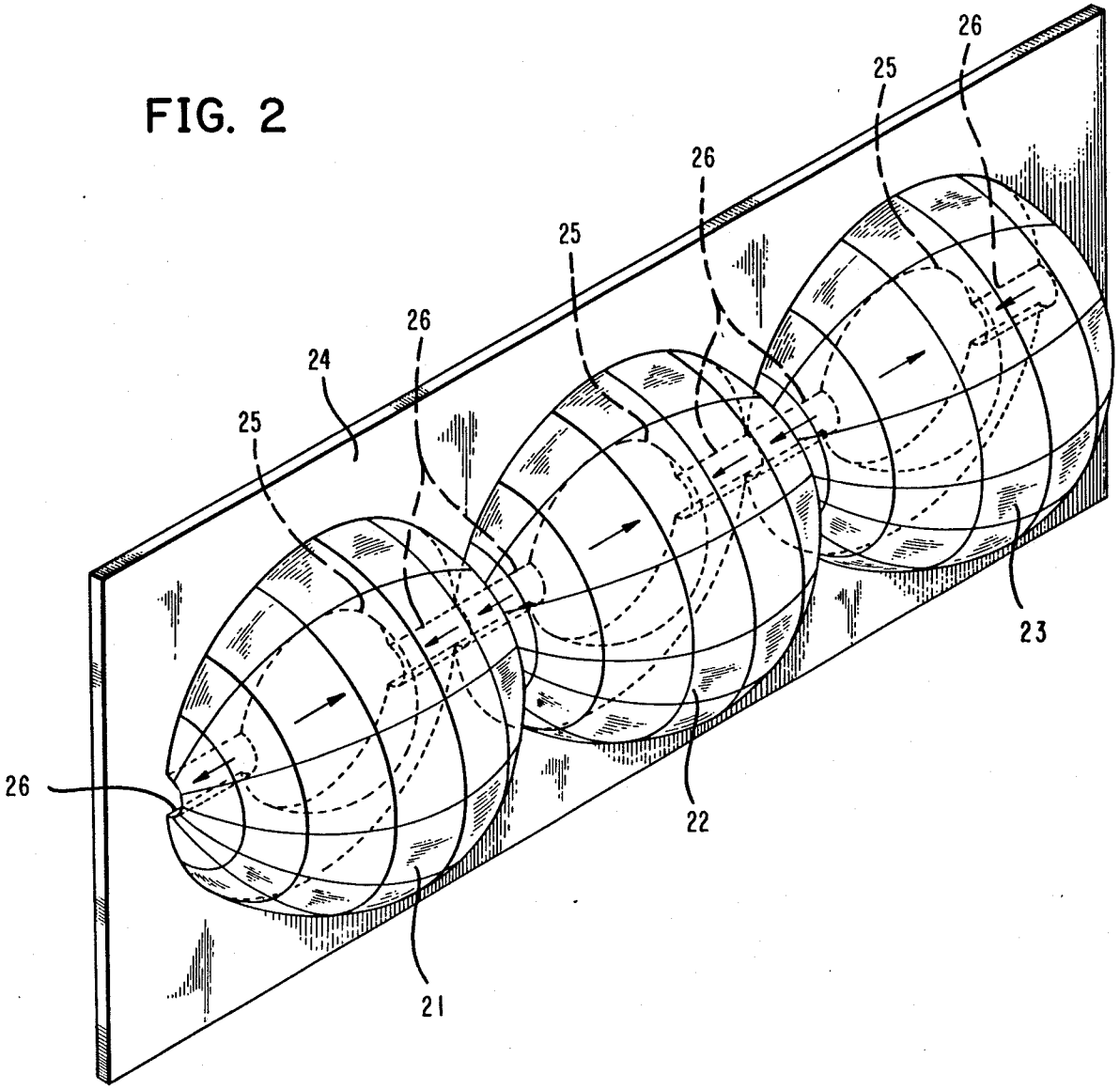
FIG. 2 shows a short series of hollow, segmented hemispherical flux sources in accordance with the present invention.

The periodic permanent magnet structures of the present invention make advantageous use of new and novel permanent magnet configurations. FIG. 2 shows a series of three coaxially aligned hollow hemispherical flux sources 21, 22, 23 which abut a superconducting plate 24. For TWT purposes upwards of 10 or more such hemispheres would be used to make up the PPM structure. However, it is to be understood that the principles of the present invention are in no way limited to any particular number of hemispheres utilized to make-up a PPM and different numbers of hemispheres may be used in different applications. The "magic" hemispheres 21–23 are each alike, and each comprises a spherical central cavity 25 and an axial bore hole 26 through the magnetic poles of the hemisphere/plate combination. The hemispheres are tangent to each other and coaxially aligned to form a continuous channel or path through which a beam of charged particles will travel. As indicated by the arrows, the magnetic field orientations in the central cavities are preferably the same, i.e., in the same axial direction. However, the magnetic field orientation in each axial bore hole is the reverse of that in each cavity. Accordingly, the desirable characteristic of continually alternating magnetization in a PPM stack is fully realized in the string of hollow hemispherical flux sources. That is, along the aforementioned channel or particle beam path the direction of the focusing magnetic field alternates or reverses in direction.

It is perhaps of advantage at this point to briefly describe the "magic igloo" itself. For a more detailed description of the same, reference may be had to the above-noted co-pending application of H. Leupold. Each hollow, hemispherical flux source (HHFS) or magic igloo 21–23 abuts a superconducting sheet 24 along longitudinal meridians 180° apart. Also, since it is not feasible to construct an "ideal" HHFS, in practice a segmented approximation is used. See the noted co-pending application for a further description of this segmented approach to an "ideal" HHFS. The segmented magnetic structure is "cut" or "sliced" to abut the superconducting plate 24 longitudinally. The magnetic "mirror" image of a hemisphere produced by the superconducting plate 24 makes the hemisphere appear as if a complete magic sphere were its source. A substantially uniform, high magnetic field is provided in each central cavity.

The magnetization of each hemisphere is azimuthally symmetrical. The magnetic orientation ($\alpha$) in the hemispherical permanent magnet shell is given by the equation $\alpha=2\theta$ where $\theta$ is the polar angle. The value $\alpha$ is the magnetization angle with respect to the polar axis.

The diamagnetic image in the superconducting plane completes each magic hemisphere—i.e., each hemispherical central cavity appears (magnetically) exactly as if a complete magic sphere were its source. The magnetic mirror extends and completes the magnetic image. That is, a virtual image of a given pole distribution is formed.

The field (H) in each hemispherical central cavity is given by $$H=(4/3)B_r \ln (r_o/r_i)$$

where $B_r$ is the remanence of the magnetic material and $r_o$ and $r_i$ are, respectively, the outer and inner radii of the hemisphere. In each segment the magnetization is constant in both amplitude and direction within any one segment, however mathematically the azimuthal field dependence is assumed to be continuous. The invention is not limited to any specific number of segments and the greater the number of segments the closer the approximation to the ideal case. In the preferred embodiment, each cavity radius is half the radius of the HHFS radius, $r_o$. However, the invention is not limited to this relation and may be varied for practical purposes as needed.

A primary feature of the present invention is the increase in heat dissipation from the central cavity of the TWT to the atmosphere. In prior designs the central cavity is surrounded by thick rings or spheres of magnetic material. The heat must pass through this thick material in order to be dissipated to the outside environment. In the present invention, the thin superconducting plate 24 is a more efficient conductor of heat and allows for greater heat dissipation through the plate area in contact with the magnetic material, the cavity(s), and the bore holes(s).

Another feature of the present invention is that it permits one to gain access to the interior of the structure in a simple and efficient manner. It is to be realized that the hollow hemispheres are kept intact. However, by raising the temperature of the superconducting plate above its critical temperature, the plate is easily separated from the hemispheres. Thus, there is ease of access. This will be appreciated by those skilled in the traveling wave tube art.

Figure 3:
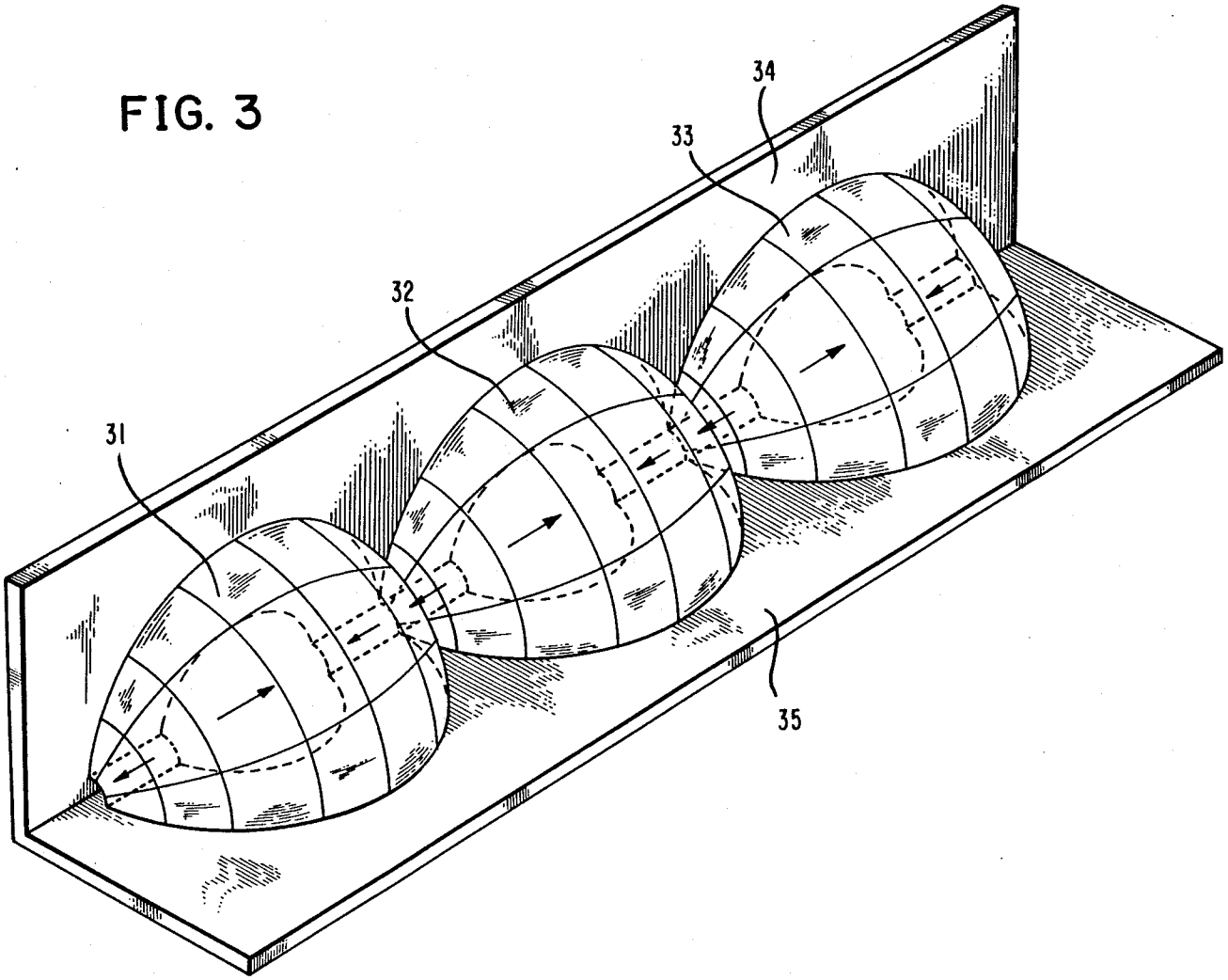
FIG. 3 shows a short series of hollow, segmented quarter spherical flux sources in accordance with the invention.

FIG. 3 shows a series of three coaxially aligned hollow quarter-spherical magnetic flux sources 31, 32, 33. These are also arranged tangentially in pearl string fashion. The bore holes are similarly aligned coaxially to form a continuous channel. The magnetic field orientations are indicated by the arrows. As is evident, the characteristic of continually alternating magnetization in the PPM stack is realized. The number of quarter spheres drawn is only an illustration of the principle of the invention and therefore the present invention is not limited to any particular number of such quarter spheres.

It would be advantageous at this point to briefly discuss the quarter spherical flux sources. A superconducting sheet 34 abuts the hollow quarter-spheres along one longitudinal meridian and a second superconducting sheet 35 abuts the quarter-spherical structures along a second longitudinal meridian ninety degrees removed from the first meridian. Each segmented quarter sphere is "cut" or "sliced" to abut the pair of diamagnetic "imaging" plates 34, 35 along a pair of longitudinal meridians 90° apart. The magnetic "mirror" images of the quarter-spherical strucctures in the diamagnetic (superconductor) planes 34, 35 makes each quarterspherical central cavity appear (magnetically) exactly as if a compete magic sphere were its source. A uniform, high magnetic field is created in each quarter-spherical cavity.

The feature of attaining a higher rate of heat dissipation is achieved by heat conduction through the thin superconducting plates 34, 35. Ease of access is similarly achieved by raising the temperature above the superconducting temperature and pulling the plates apart from the magnetic quarter spheres.

The plates or planar sheets 24, 34, and 35 can, in bulk form, be composed of tin, lead, niobium, tantalum, etc. Each of these materials, and others, are known to be superconducting below a distinct critical temperature. Moreover, recent developments in the field of superconductivity have produced a large variety of new ceramic-type materials which are capable of achieving the superconducting state at critical temperatures above 77° K., the boiling point of liquid nitrogen. By way of example, an entire class of superconducting compounds with the chemical composition $RBa_2Cu_3O_{9-y}$ (where R stands for a transition metal or a rare earth ion and y is a number less than 9, preferably $2.1\pm0.05$) has demonstrated superconductive properties have above 90° K. The superconducting ceramics are formed by plasma-spraying techniques, or sputtered or evaporated onto a substrate (magnesium oxide), or produced by growing epitaxial films ($RBa_2Cu_3O_{7-x}$) on a substrate (e.g., $SrTiO_3$), etc. It is to be understood, however, that the present invention is in no way limited to the superconducting material selected for the superconductor planar sheets or, if the same is a superconductive-ceramic, the manner in which the same is formed.

There are various techniques known to those skilled in the art for bringing (i.e., cooling) the superconductor plate material to its distinct critical temperature. For example, the use of cryorefrigerator means such as disclosed in the co-pending application of L. J. Jasper Jr., Ser. No. 068,389, filed June 12, 1987, can be advantageously utilized to cool the superconducting plates. However, since the same comprises no part of the present invention and one or more of these known techniques will suffice for present purposes, further detailed discussion herein would not appear to be necessary.

Other and different approximations to the hollow partial flux sources arranged in pearl string fashion may occur to those skilled in the art. Accordingly, having shown and described what is at present considered to be several preferred embodiments of the invention, it should be understood that the same has been shown by way of illustration and not limitation. And, all modifications, alterations, and changes coming within the spirit and scope of the invention are herein meant to be included.

What is claimed is:

1. A periodic permanent magnet structure comprising a plurality of azimuthally circumscribed sections of hollow spherical flux sources, each section having an axial bore hole through the magnetic poles of the same, said sections being placed tangent to each other with the axial bore holes of the sections coaxially aligned with each other so as to form a continuous channel through the plurality of sections, and one superconducting planar sheet abutting a flat face of the sections so as to provide a uniform high-field in each central cavity.

2. A periodic permanent magnet structure as defined in claim 1 wherein said sections comprise hollow hemispherical magnetic flux sources which abut a single superconducting planar sheet along longitudinal meridians 180° apart.

3. A periodic magnet structure as defined in claim 2 wherein the magnetic field orientation in each axial bore hole is the reverse of that in each cavity.

4. A periodic permanent magnet structure as defined in claim 3 wherein each hemisphere is comprised of a multiplicity of segments.

5. A periodic permanent magnet structure as defined in claim 4 wherein the magnetization of each hemisphere is azimuthally symmetrical, the magnetic orientation ($\alpha$) in the hemispherical permanent magnet shell being given by the equation $\alpha=2\theta$ where $\theta$ is the polar angle.

6. A periodic permanent magnet structure as defined in claim 5 wherein the field (H) in each hemispherical central cavity is given by $$H=(4/3)B_r \ln (r_o/r_i)$$

where $B_r$ is the remanence of the magnetic material and $r_o$ and $r_i$ are respectively the outer and inner radii of the hemisphere.

7. A periodic permanent magnet structure as defined in claim 1 wherein said sections comprise hollow quarter spherical magnetic flux sources which abut a superconducting planar sheet along one longitudinal meridian and a second superconducting planar sheet along a second longitudinal meridian ninety degrees removed from the first meridian.

8. a periodic permanent magnet structure as defined in claim 7 wherein the magnetic field orientation in each axial bore hole is the reverse of that in each cavity.

9. A periodic permanent magnet structure as defined in claim 8 wherein each quarter-sphere is comprised of a multiplicity of segments.

10. A periodic permanent magnet structure as defined in claim 9 wherein the magnetization of each quarter-sphere is azimuthally symmetrical, the magnetic orientation ($\alpha$) in the quarter-spherical permanent magnet shell being given by the equation $$\alpha=2\theta$$

where $\theta$ is the polar angle.

11. A periodic permanent magnet structure as defined in claim 10 wherein the field (H) in each quarter-spherical central cavity is given by $$H=(4/3)B_r \ln (r_o/r_i)$$

where $B_r$ is the remanence of the magnetic material and $r_o$ and $r_i$ are respectively the outer and inner radii of the quarter-sphere.

* * * * *